US009296087B2

(12) United States Patent
Staudhammer

(10) Patent No.: US 9,296,087 B2
(45) Date of Patent: Mar. 29, 2016

(54) METHOD FOR CONDITIONING POLISHING PADS FOR THE SIMULTANEOUS DOUBLE-SIDE POLISHING OF SEMICONDUCTOR WAFERS

(71) Applicant: Siltronic AG, Munich (DE)

(72) Inventor: Johannes Staudhammer, Burghausen (DE)

(73) Assignee: SILTRONIC AG, Munich (DE)

( * ) Notice: Subject to any disclaimer, the term of this patent is extended or adjusted under 35 U.S.C. 154(b) by 0 days.

(21) Appl. No.: 14/180,392

(22) Filed: Feb. 14, 2014

(65) Prior Publication Data

US 2014/0235143 A1 Aug. 21, 2014

(30) Foreign Application Priority Data

Feb. 15, 2013 (DE) ..... 10 2013 202 488

(51) Int. Cl.
*B24B 53/017* (2012.01)

(52) U.S. Cl.
CPC ..... *B24B 53/017* (2013.01)

(58) Field of Classification Search
CPC ..... B24B 53/017; B24B 53/00
USPC ..... 451/56, 443, 444, 72, 291, 269, 271
See application file for complete search history.

(56) References Cited

U.S. PATENT DOCUMENTS

| | | | | |
|---|---|---|---|---|
| 6,042,688 | A | 3/2000 | Masumura et al. | |
| 6,254,461 | B1 * | 7/2001 | Benning et al. | 451/56 |
| 6,338,672 | B1 * | 1/2002 | White | 451/443 |
| 2002/0052064 | A1 | 5/2002 | Grabbe et al. | |
| 2008/0233840 | A1 | 9/2008 | Pietsch et al. | |
| 2009/0258581 | A1 | 10/2009 | Hamill | |
| 2012/0028546 | A1 | 2/2012 | Pietsch et al. | |
| 2012/0028547 | A1 | 2/2012 | Takai | |
| 2012/0189777 | A1 | 7/2012 | Pietsch | |

FOREIGN PATENT DOCUMENTS

| | | | |
|---|---|---|---|
| CN | 1460043 | A | 12/2003 |
| CN | 101708594 | A | 5/2010 |
| DE | 112012000173 | T5 | 8/2013 |
| JP | 6226628 | A | 8/1994 |
| JP | 9193002 | A | 7/1997 |
| JP | 200246058 | A | 2/2002 |
| JP | 2002046057 | A | 2/2002 |

(Continued)

*Primary Examiner* — Robert Rose
(74) *Attorney, Agent, or Firm* — Leydig, Voit & Mayer, Ltd.

(57) ABSTRACT

A method for conditioning polishing pads for the simultaneous double-side polishing of semiconductor wafer uses a double-side polishing device. The device has an annular lower polishing plate and an annular upper polishing plate, each covered with a polishing pad, as well as a rolling device for carrier disks. The method for conditioning polishing pads includes disposing at least one conditioning tool having external teeth and at least one spacer having external teeth in a working gap formed between the first and second polishing pad, where the thickness of at least one of the conditioning tools differs from the thickness of at least one of the spacers. At least one conditioning tool and one spacer are set, simultaneously, in a revolving movement about the axis of the rolling device and in rotation themselves so as to generate material abrasion of at least one of the polishing pads.

20 Claims, 2 Drawing Sheets

(56) References Cited

FOREIGN PATENT DOCUMENTS

| | | | |
|---|---|---|---|
| JP | 2011224699 | A | 11/2011 |
| TW | 358056 | | 6/1989 |
| TW | 200849368 | A | 12/2008 |
| TW | 201206632 | A | 2/2012 |
| TW | 201231218 | A | 8/2012 |
| WO | WO 2013039571 | A1 | 3/2013 |

* cited by examiner

METHOD FOR CONDITIONING POLISHING PADS FOR THE SIMULTANEOUS DOUBLE-SIDE POLISHING OF SEMICONDUCTOR WAFERS

CROSS REFERENCE TO RELATED APPLICATIONS

This application claims priority from German Patent Application No. DE 10 2013 202 488.6, filed Feb. 15, 2013, which is hereby incorporated by reference herein in its entirety.

FIELD

The invention relates to a method for conditioning polishing pads for the simultaneous double-side polishing of semiconductor wafers in a double-side polishing device having two annular polishing plates covered with a polishing pad and a rolling device for carrier disks, the polishing plates and the rolling device being mounted rotatably about collinearly arranged axes.

BACKGROUND

Semiconductor wafers, in particular of monocrystalline silicon, are needed as basic materials for the production of electronic components. The manufacturers of such components require that the semiconductor wafers have as far as possible planar and plane-parallel surfaces. In order to meet this requirement, the semiconductor wafers are subjected to a series of processing steps which improve the planarity and plane-parallelism of the sides and reduce their roughness. In the scope of this processing, one or more polishing steps are usually carried out.

Double-side polishing (DSP), in which both surfaces (front side and back side) of the semiconductor wafer are simultaneously polished in the presence of a polishing agent in the form of a suspension (also referred to as a slurry), is particularly suitable. During the double-side polishing, the semiconductor wafer together with further semiconductor wafers is placed in a gap between a lower polishing pad and an upper polishing pad. This gap is referred to as the working gap. Each of the polishing pads covers a corresponding lower or upper polishing plate. During the double-side polishing, the semiconductor wafers lie in recesses of carrier disks which guide and protect them. The carrier disks are externally toothed disks, which are arranged between an inner and an outer toothed wheel or pin gear of the polishing device. A toothed wheel or pin gear will be referred to below as a drive gear. During the polishing process, the carrier disks are set in rotation about their own axis and simultaneously in a revolving movement about the axis of the polishing device by rotation of the inner drive gear or by rotation of the inner and outer drive gears. Furthermore, the polishing plates are usually also rotated about their axes. For the double-side polishing, this results in characteristic so-called planetary kinematics, in which a point on a side of the semiconductor wafer describes a cycloid path on the corresponding polishing pad.

One main purpose of the double-side polishing of semiconductor wafers is to improve the global and local geometry. In this case, a semiconductor wafer which is as planar as possible is intended to be produced without edge roll-off in an economical process. This can be achieved by interaction of the various process parameters in the polishing process. One important parameter is the polishing gap between the upper and lower polishing pads. In this context, the conditioning of the polishing pad surfaces plays a crucial role for the polishing process. During the conditioning, on the one hand the surface of the polishing pad is cleaned (dressing) and on the other hand slight material abrasion is induced in order to impart the desired—generally as planar as possible—geometry to the polishing pad surface (truing).

Usually, the polishing pads are in this case processed with conditioning disks whose surfaces facing toward the polishing pad are coated with abrasive particles, for example diamond. The conditioning disks have external teeth, so that they can be placed like a carrier disk on the lower polishing pad, the external teeth engaging with the inner and outer drive gears. The upper polishing plate is placed on the conditioning disks, so that the conditioning disks lie in the working gap between the upper and lower polishing pads. During the conditioning, similar kinematics are used as in the polishing. The conditioning disks therefore move during the conditioning process with planetary kinematics in the working gap and process the upper or lower polishing pad, or both polishing pads, depending on whether conditioning disks coated with abrasive on one or both sides are used.

With this standard method, a plane-parallel working gap can be achieved. Furthermore, unevennesses on the polishing pad surfaces can be removed. It has been assumed that an optimal geometry of the polished semiconductor wafers can be achieved by a working gap which is as plane-parallel as possible.

US2012/0028547A1 describes a possibility of imparting a correspondingly concave or convex surface shape to the polishing pads by using conditioning tools with a convex or concave surface. The conditioning tools, like the semiconductor wafers to be polished, are placed in the recesses of the carrier disks. In this way, the geometry for the polishing pad surface can be adjusted in such a way that the geometry of the polished semiconductor wafers is improved. For example, it is indicated that a pronounced biconcave configuration of the polished semiconductor wafers can be avoided by concave polishing pad surfaces (i.e. a small width of the polishing gap at the inner and outer edges of the polishing plates and a larger gap width at the radial center of the polishing plates).

However, it has been found that even this measure is not sufficient in order to satisfy the increasing requirements for the geometry of the polished semiconductor wafers.

SUMMARY

In an embodiment, the present invention provides a method for conditioning polishing pads for the simultaneous double-side polishing of semiconductor wafer uses a double-side polishing device. The device has an annular lower polishing plate and an annular upper polishing plate, each covered with a polishing pad, as well as a rolling device for carrier disks. The method for conditioning polishing pads includes disposing at least one conditioning tool having external teeth and at least one spacer having external teeth in a working gap formed between the first and second polishing pad, where the thickness of at least one of the conditioning tools differs from the thickness of at least one of the spacers. At least one conditioning tool and one spacer are set, simultaneously, in a revolving movement about the axis of the rolling device and in rotation themselves so as to generate material abrasion of at least one of the polishing pads.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
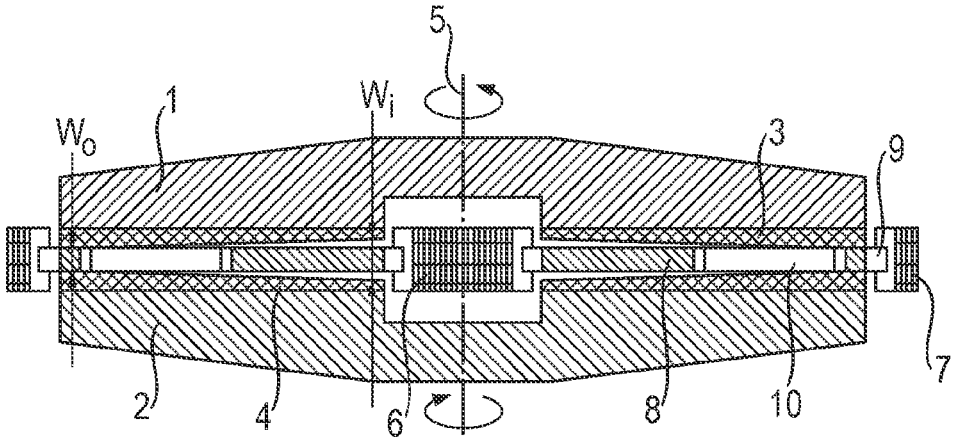
FIG. 1 shows a vertical section through a double-side polishing device having a polishing gap produced according to the invention.

An aspect of the invention is to further improve the geometry of the polished semiconductor wafers.

In an embodiment, the present invention provides a method for conditioning polishing pads for the simultaneous double-side polishing of semiconductor wafers in a double-side polishing device having an annular lower polishing plate, an annular upper polishing plate and a rolling device for carrier disks, the lower polishing plate, the upper polishing plate and the rolling device being mounted rotatably about collinearly arranged axes, and the lower polishing plate being covered with a first polishing pad and the upper polishing plate is covered with a second polishing pad, wherein at least one conditioning tool having external teeth and at least one spacer having external teeth are set in a revolving movement about the axis of the rolling device and simultaneously in rotation on themselves by means of the rolling device in a working gap formed between the first and second polishing pads, so that the at least one conditioning tool generates material abrasion of at least one of the two polishing pads by its relative movement, the thickness of the at least one conditioning tool differing from the thickness of the at least one spacer.

The studies which led to the present invention have shown that the geometry of the polished semiconductor wafers can be further improved by varying the width of the polishing gap from the outer edge to the inner edge. An influence of this size on the geometry of the polished semiconductor wafers was previously unknown and was not to be expected. By means of a simple conditioning method, without great outlay, the method according to the invention makes it possible to produce a working gap with a gap width varying in the radial direction.

The method according to the invention is used to prepare a double-side polishing device according to the prior art, as described above. After the method has been carried out, double-side polishing of semiconductor wafers can be carried out according to the prior art, but in a working gap having a gap width varying in the radial direction.

The double-side polishing device and its use for polishing semiconductor wafers will firstly be described below.

The upper polishing pad 3 (see FIG. 1) is fixed on the upper polishing plate 1, and the lower polishing pad 4 is fixed on the lower polishing plate 2. Between the surfaces of the polishing pads facing toward one another, there is the working gap. In the working gap, there are the carrier disks 8 with teeth 9, which engage with the inner drive gear 6 and the outer drive gear 7. The drive gears 6, 7 may be toothed wheels or pin gears. The two drive gears 6, 7 together form a rolling device for the carrier disks 8, that is to say by rotation of at least one drive gear or preferably both drive gears the carrier disks 8 are set in rotation about their own axis and simultaneously in a revolving movement about the rotation axis of the rolling device. The rotation axes 5 of the polishing plates and of the drive gears forming the rolling device are arranged collinearly. The carrier disks 8 have recesses 10, in which the semiconductor wafers to be polished can be placed while being freely mobile. A polishing device simultaneously contains at least three carrier disks. Fitting with five carrier disks simultaneously is also usual. Depending on the dimensions of the polishing device and of the semiconductor wafers, a carrier disk in turn has at least one recess 10 for placement of a semiconductor wafer. In general, however, a carrier disk has three or more recesses 10 for semiconductor wafers.

The effect of the conditioning method according to the invention is that the width of the working gap at the inner edge of the polishing pads (wi) 3, 4 differs from the width wo of the working gap at the outer edge of the polishing pads (wo) 3, 4, as represented in FIG. 1. The preferred amount of this difference depends primarily on the size of the polishing plates. What is crucial in this case is the ring width of the polishing pads, that is to say the distance between the inner and outer edges of the polishing pads. Preferably, the difference between the two gap widths wi and wo is at least 70 μm, particularly preferably at least 140 μm, per meter of ring width of the polishing pads. Preferably, the difference is at most 300 μm. (With a ring width of half a meter, the difference between the two gap widths wi and wo is consequently preferably at least 35 μm and particularly preferably at least 70 μm. The maximum value is in this case preferably 150 μm.)

It has been found that a particularly good global and local geometry of the semiconductor wafers can be achieved when the width of the polishing gap at the inner edge is greater than at the outer edge, particularly when the preferred ranges described above are complied with. The polished semiconductor wafers are more planar overall (global geometry) and have a reduced edge roll-off (local geometry).

A monotonic profile of the polishing gap width, particularly preferably a linear profile as a function of the radial position, is preferred.

The working gap having the described gap width difference between the inner and outer edges is adjusted according to the invention by at least one of the two polishing pads being shaped by conditioning before carrying out the polishing process. In this case, a different amount of material is abraded from at least one of the two polishing pads as a function of the radial position. If more material is abraded at the inner edge than at the outer edge, then there is a greater width of the working gap at the inner edge compared with the outer edge, and vice versa. It is possible to condition only one of the two polishing pads correspondingly, so that the radial profile of the polishing gap width corresponds to the radial profile of the material abrasion and therefore to the radial profile of the thickness of the conditioned polishing pad. It is, however, also possible to condition both polishing pads as a function of the radial position, so that the contributions of the two polishing pad surfaces to the radial gap width profile are added together.

Preferably, the conditioning method according to the invention is applied to hard polishing pads with low compressibility, since the desired thickness, dependent on the radial position, cannot readily be imparted to soft compressible polishing pads by a conditioning process. A compressibility of at most 3%, and particularly preferably at most 2.5%, is preferred. The determination of the compressibility is carried out in a similar way to the standard JIS L-1096. A hardness of the polishing pads of from 80 to 100 Shore A is preferred.

The conditioning process according to the invention is represented in FIGS. 2 to 5. In this case, the at least one polishing pad 3, 4 is conditioned by setting at least one conditioning tool 11 having external teeth 12 and at least one spacer 14 having external teeth 15 in rotation in the working gap by means of the rolling device 6, 7.

For the purpose of conditioning the polishing pads 3, 4, the conditioning tools 11 and spacers 14 are placed in the double-side polishing device instead of the carrier disks 8. Both the conditioning tools 11 and the spacers 14 have similar external teeth as the carrier disks 8. The conditioning tools 11 and spacers 14 are dimensioned in such a way that their external teeth 12, 15 can engage with the inner and outer drive gears 6, 7 of the rolling device. The conditioning tools may be configured circularly or annularly.

The conditioning tools 11 have surface regions 13 which are coated with abrasive particles, for example diamond. Preferably, the surface regions 13 coated with abrasive particles are arranged in the form of a ring on the conditioning tool along the external teeth 12.

By rotation of at least one of the drive gears 6, 7, the conditioning tools 11 and spacers 14 are set in rotation about their own axis and simultaneously in a revolving movement about the center of the double-side polishing device, that is to say about the rolling device rotation axis extending collinearly with the rotation axis 5 of the polishing plates. At the same time, at least the polishing plate covered with the polishing pad to be conditioned is preferably set in rotation. When the two polishing pads are conditioned simultaneously, both polishing plates are preferably set in rotation. By the relative movement between the conditioning tools and the at least one polishing pad, material abrasion of the polishing pad 3, 4 in question is generated by the surface regions 13 of the conditioning tools 11 which are coated with abrasive particles.

It is possible to use conditioning tools 11 which have surface regions 13 coated with abrasive particles only on one side, or alternatively on both sides. If only one of the two polishing pads is intended to be conditioned, one-sided conditioning tools will be used. If both polishing pads are to be conditioned, one-sided conditioning tools may likewise be used. In this case, the conditioning of the upper and lower polishing pads is carried out sequentially. It is, however, preferable in this case to use double-sided conditioning tools which have surface regions 13 coated with abrasive particles on both sides (as represented in FIG. 2) and therefore allow simultaneous conditioning of the two polishing pads.

The spacers 14 are needed in order to achieve radially nonuniform material abrasion of the polishing pads during the conditioning. In order to fulfill their function, the thickness dS of the spacers 14 must differ from the thickness dD of the conditioning tools 11. In order to produce a gap width difference in the range described above in conventional DSP devices having a polishing pad ring width of half a meter or more, a thickness difference of at least 0.1 mm between the conditioning tools and the spacers is necessary.

Figure 2:
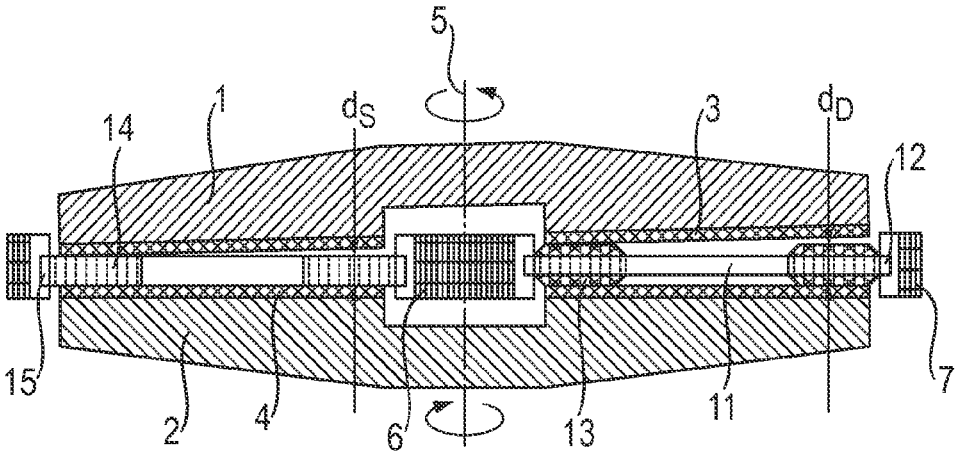
FIG. 2 shows a vertical section through a double-side polishing device during a conditioning process according to the invention.

The functionality of the method according to the invention is represented in FIG. 2. The pendular mounting of the upper polishing plate is used in this case. This is necessary since the upper polishing plate must be capable of compensating for a height excursion or wobbling of the lower polishing plate and adapt to this movement. For this reason, all conventional double-side polishing devices have pendular mounting of the upper polishing plate. The spacers do not have surfaces coated with abrasives, and therefore do not generate any material abrasion of the polishing pads. They are merely used to tilt the upper polishing plate. Conventional carrier disks which have the required thickness may also be used as spacers.

In the case represented in FIG. 2, the thickness dD of the conditioning tools 11 is greater than the thickness dS of the spacers 14. This leads to slight tilting of the pendularly suspended upper polishing plate 1, which is lowered further in the region of the thinner spacers 14 than in the region of the thicker conditioning tools 11. This in turn leads to an increased load on the inner part, as seen radially, of the conditioning tools (i.e. in FIG. 2 in the left-hand region of the conditioning tool 11 represented there) and therefore to increased material abrasion in the region of the inner edge of the polishing pads 3, 4, which lies next to the inner drive gear 6.

Increased material abrasion at the inner edge of the polishing pads (and therefore a greater working gap width at the inner edge, i.e. wi>wo, as represented in FIG. 1) can therefore be produced by a smaller thickness of the spacers in comparison with the conditioning tools (as represented in FIG. 2). Conversely, increased material abrasion at the outer edge of the polishing pads (and therefore a greater working gap width at the outer edge, i.e. wo>wi) can be produced by a greater thickness of the spacers in comparison with the conditioning tools.

The direction and extent of the tilt of the upper polishing plate, and therefore of the radial gap width difference, are determined by the thickness difference between the conditioning tools and the spacers. In the case of a polishing pad ring width of 700 mm, for example, a working gap having a gap width which is 300 μm greater at the inner edge than at the outer edge (i.e. wi−wo=300 μm) can be produced by the thickness dS of the spacers being selected to be about 1 mm less than the thickness dD of the conditioning tools (dD−dS=1 mm) Conversely, a working gap which is 300 μm larger at the outer edge (wi−wo=−300 μm) can be produced by selecting dD−dS=−1 mm. With the same DSP system dimensions, smaller gap width differences can be achieved by correspondingly smaller thickness differences between the conditioning tools and the spacers. For larger DSP systems, a correspondingly larger thickness difference is necessary in order to produce a particular gap width difference, and in smaller DSP systems a correspondingly smaller thickness difference.

With given thicknesses of the conditioning tools and spacers, fine adjustment of the tilting is possible through the selection of the distances of the conditioning tools and spacers from one another.

Figure 3:
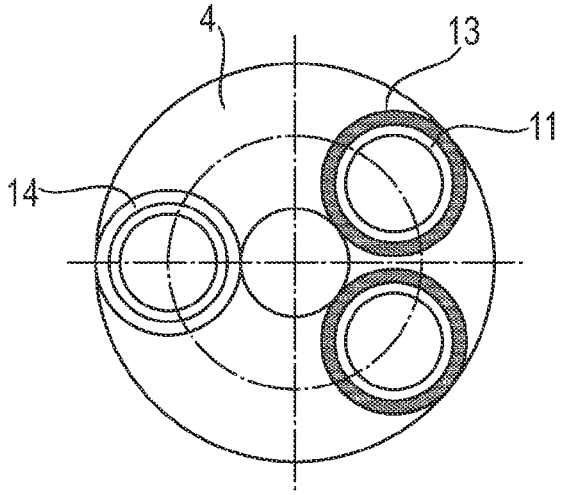
FIG. 3 shows the lower polishing plate of the double-side polishing device with a possible arrangement of two conditioning tools and one spacer, according to one embodiment of the invention.
Figure 4:
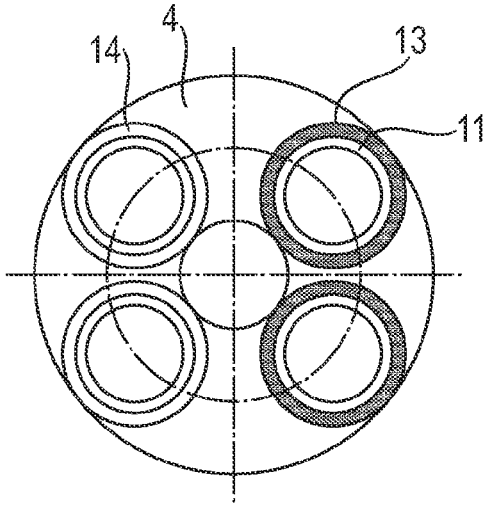
FIG. 4 shows the lower polishing plate of the double-side polishing device with a possible arrangement of two conditioning tools and two spacers, according to another embodiment of the invention.
Figure 5:
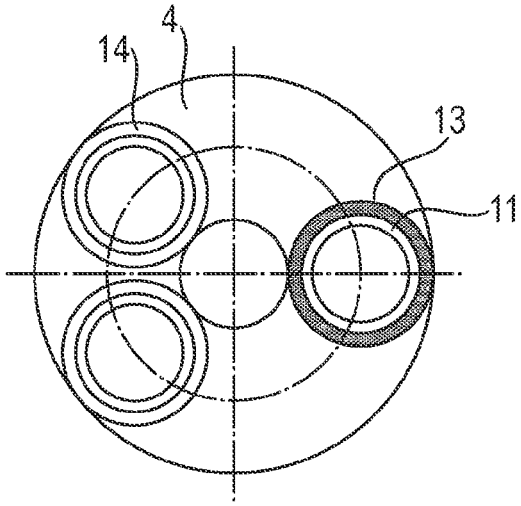
FIG. 5 shows the lower polishing plate of the double-side polishing device with a possible arrangement of one conditioning tool and two spacers, according to a further embodiment of the invention.

As described above, during the conditioning it is necessary to tilt the upper polishing plate slightly by the different thickness of the conditioning tools and the spacers, in order to achieve material abrasion of the polishing pads dependent on the radial position. In principle, it is possible to achieve this effect with one conditioning tool 11 and an oppositely installed spacer 14. This, however, can lead to an unstable position of the upper polishing plate. It is therefore preferred to use either at least two adjacently arranged conditioning tools 11 or at least two adjacently arranged spacers 14, as represented in FIGS. 3 to 5. The figures show a plan view of the lower polishing plate (more precisely of the lower polishing pad 4) with conditioning tools 11 and spacers 14 applied. It is particularly preferred to use one conditioning tool 11 and two spacers 14 (FIG. 5) or two conditioning tools 11 and one spacer 14 (FIG. 3). In these cases, the upper polishing plate 1 bears stably on three points. It is also possible to use two conditioning tools 11 and two spacers 14 (FIG. 4). In this case, the two conditioning tools 11 and spacers 14 must respectively lie next to one another in order to tilt the upper polishing plate 1 owing to the thickness difference between the conditioning tools 11 and spacers 14.

The conditioning process according to the invention, in which the material abrasion of the polishing pad, dependent on the radial position, is achieved by means of differently thick conditioning tools and spacers, has the advantage that it is carried out with rotation of the conditioning tools. The formation of grooves or indentations on the conditioned polishing pads is thereby avoided. An essential advantage of the conditioning method is therefore retained. At the same time, a polishing gap can be produced by simple means with a freely selectable gap width difference between the inner and outer edges. Likewise, used polishing pads worn to a different extent can be returned to the desired shape by the described method.

It would also be conceivable to achieve the different width of the polishing gap between the inner and outer edges of the polishing plates by deformation of at least one of the two polishing plates. Double-side polishing machines which allow hydraulic deformation of the upper polishing plate are known. It has, however, been found that a gap width difference caused by a different polishing pad thickness at the inner and outer edges of the polishing pad has a substantially greater effect than an equally large gap width difference which is achieved by a corresponding polishing plate deformation. The adjustment of the gap width difference by means of material abrasion, dependent on the radial position, during the conditioning furthermore has the advantage that this method can also be used in polishing machines which do not have a deformable polishing plate.

The method according to the invention can be used to prepare polishing pads for the double-side polishing of any semiconductor wafers. Use in the polishing of silicon wafers, in particular monocrystalline silicon wafers, is particularly preferred owing to their great economic importance and the very demanding geometry requirements.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SYMBOL LIST

1 upper polishing plate
2 lower polishing plate
3 upper polishing pad
4 lower polishing pad
5 rotation axis of the polishing plates
6 inner drive gear
7 outer drive gear
8 carrier disk
9 teeth of the carrier disk
10 recess in the carrier disk for placement of a semiconductor wafer
11 conditioning tool
12 teeth of the conditioning tool
13 conditioning tool surface coated with abrasive particles
14 spacer
15 teeth of the spacer
dS thickness of the spacer
dD thickness of the conditioning tool
wi width of the working gap at the inner edge
wo width of the working gap at the outer edge

What is claimed is:

1. A method for conditioning polishing pads for the simultaneous double-side polishing of semiconductor wafers in a double-side polishing device having an annular lower polishing plate covered with a first polishing pad, an annular upper polishing plate covered with a second polishing pad and a rolling device for carrier disks, the lower polishing plate, the upper polishing plate, and the rolling device being mounted rotatably about collinearly arranged axes, the method comprising:

disposing at least one conditioning tool having external teeth and at least one spacer having external teeth in a working gap formed between the first and second polishing pad, the thickness of the at least one conditioning tool differing from the thickness of the at least one spacer;

setting, simultaneously, the at least one conditioning tool and the least one spacer in revolving movement about the axis of the rolling device and in rotation themselves using the rolling device so as to generate material abrasion of at least one of the two polishing pads by the relative movement of the at least one conditioning tool.

2. The method as recited in claim 1, further comprising setting the polishing plate covered with the polishing pad to be conditioned in rotation during the conditioning.

3. The method as recited in claim 1, wherein the thickness of the at least one conditioning tool differs by at least 0.1 mm from the thickness of the at least one spacer.

4. The method as recited in claim 1, wherein the thickness of the at least one conditioning tool is greater than the thickness of the at least one spacer.

5. The method as recited in claim 1, wherein at least two conditioning tools, which are arranged adjacent to one another, are used.

6. The method as recited in claim 1, wherein at least two spacers, which are arranged adjacent to one another, are used.

7. The method as recited in claim 1, wherein, after the conditioning, the width of the working gap at the inner edge of the polishing pads differs from the width of the working gap at the outer edge of the polishing pads.

8. The method as recited in claim 7, wherein the width of the working gap at the inner edge of the polishing pads differs by at least 70 μm per meter of ring width of the polishing pads from the width of the working gap at the outer edge of the polishing pads.

9. The method as recited in claim 7, wherein the width of the working gap at the inner edge of the polishing pads differs by at least 140 μm per meter of ring width of the polishing pads from the width of the working gap at the outer edge of the polishing pads.

10. The method as recited in claim 7, wherein the width of the working gap at the inner edge of the polishing pads differs by at most 300 μm per meter of ring width of the polishing pads from the width of the working gap at the outer edge of the polishing pads.

11. The method as recited in claim 7, wherein the width of the working gap at the inner edge of the polishing pads is greater than the width of the working gap at the outer edge of the polishing pads.

12. A method of polishing semiconductor wafers, the method comprising:

carrying out the method of claim 1; and, thereafter simultaneously double-side polishing at least three semiconductor wafers in the working gap formed between the first and second polishing pads with rotation of the lower and upper polishing plates.

13. The method as recited in claim 12, wherein each of the semiconductor wafers undergoing simultaneous double-side polishing is freely mobile in a recess of one of at least three carrier disks provided with external teeth.

14. The method as recited in claim 13, wherein the carrier disks are set in rotation using the rolling device so that the semiconductor wafers are moved on a cycloid path in the working gap.

15. The method as recited in claim 1, wherein a width of the working gap at an inner edge of the polishing pads is greater, by at least 70 μm per meter of ring width of the polishing pads, than a width of the working gap at an outer edge of the polishing pads.

16. The method as recited in claim 1, wherein a width of the working gap at an inner edge of the polishing pads is greater, by at least 140 μm per meter of ring width of the polishing pads, than a width of the working gap at an outer edge of the polishing pads.

17. The method as recited in claim 11, wherein a width of the working gap at an inner edge of the polishing pads is no more than 300 μm per meter of ring width of the polishing pads greater than a width of the working gap at the an edge of the polishing pads.

18. The method as recited in claim 15, wherein a width of the working gap at an inner edge of the polishing pads is no more than 300 μm per meter of ring width of the polishing pads greater than a width of the working gap at the an edge of the polishing pads.

19. The method as recited in claim 16, wherein a width of the working gap at an inner edge of the polishing pads is no more than 300 μm per meter of ring width of the polishing pads greater than a width of the working gap at the an edge of the polishing pads.

20. The method as recited in claim 1, wherein the spacers do not generate any material abrasion of the polishing pads.

* * * * *